US005238181A

United States Patent [19]

Mahler

[11] Patent Number: 5,238,181

[45] Date of Patent: Aug. 24, 1993

[54] CONTAINER WITH INTEGRAL POURING SPOUT AND METHOD OF MANUFACTURE

[75] Inventor: Steven Mahler, Bayside, N.Y.

[73] Assignee: Shorwood Technologies, Inc., Wilmington, Del.

[21] Appl. No.: 938,273

[22] Filed: Aug. 31, 1992

[51] Int. Cl.[5] ..... B65D 5/74

[52] U.S. Cl. ..... 229/215; 229/221; 493/87; 493/128; 493/162

[58] Field of Search ..... 229/215, 217, 218, 219, 229/221; 493/87, 121, 128, 162

[56] References Cited

U.S. PATENT DOCUMENTS

| | | | |
|---|---|---|---|
| 1,539,985 | 6/1925 | Allen | 229/215 |
| 1,837,749 | 12/1931 | Becker | 229/219 |
| 1,907,939 | 5/1933 | Venning et al. | 229/215 |
| 1,914,543 | 6/1933 | Trost | 229/217 |
| 2,019,943 | 11/1935 | Venning et al. | 229/217 |
| 2,029,747 | 2/1936 | Venning et al. | 229/215 |
| 2,233,488 | 3/1941 | Powell . | |
| 2,330,464 | 9/1943 | Atterbury . | |
| 2,358,659 | 9/1944 | Ringler | 229/215 |
| 2,488,323 | 11/1949 | Parker . | |
| 2,576,594 | 11/1951 | Goldstein | 493/87 |
| 2,701,679 | 2/1955 | Goldstein | 229/215 |
| 2,760,708 | 8/1956 | Phillips | 229/215 |
| 2,772,823 | 12/1956 | Plamann . | |
| 2,885,933 | 5/1959 | Phillips | 493/87 |
| 3,017,065 | 1/1962 | Collie . | |
| 3,055,571 | 9/1962 | Hassler . | |
| 3,178,090 | 4/1965 | Connell . | |
| 3,184,137 | 5/1965 | Mohler | 229/215 |
| 3,227,329 | 1/1966 | Kersh et al. . | |
| 3,228,573 | 1/1966 | Nerenberg et al. . | |
| 3,344,972 | 10/1967 | Robinson et al. | 729/215 |
| 3,549,079 | 12/1970 | Northrup | 229/215 |
| 3,570,743 | 3/1971 | Mohler . | |
| 3,605,578 | 9/1971 | Sternau | 493/87 |
| 4,054,240 | 10/1977 | LaPierre | 229/215 |
| 4,168,003 | 9/1979 | Wysocki | 229/217 |
| 4,194,677 | 3/1980 | Wysocki | 229/215 |
| 4,569,443 | 2/1986 | Roccaforte | 229/215 |
| 4,770,325 | 9/1988 | Gordon et al. | 229/125.15 |
| 4,798,296 | 1/1989 | Lagerstedt et al. | 206/631.2 |

FOREIGN PATENT DOCUMENTS

| | | | |
|---|---|---|---|
| 233475 | 3/1960 | Australia | 229/215 |

*Primary Examiner*—Gary E. Elkins
*Attorney, Agent, or Firm*—Darby & Darby

[57] ABSTRACT

A container with an integral pouring spout a method for manufacturing the same are provided, the container being manufactured from a planar blank by means of a manufacturing process which involves only a small number of very simple steps. The container has a pouring spout which is formed integrally with one of the walls of the container, and during the assembly of the container, portions of the spout are aligned with grooves in the opening for the spout, so that the components of the spout are guided, whereby the spout is opened and set up in a controlled manner. The spout is covered by an overlying layer of material and the region above the spout is perforated. The upper extreme of the perforated region extends above the top of the container to permit easy grasping and removal of the perforated region.

5 Claims, 4 Drawing Sheets

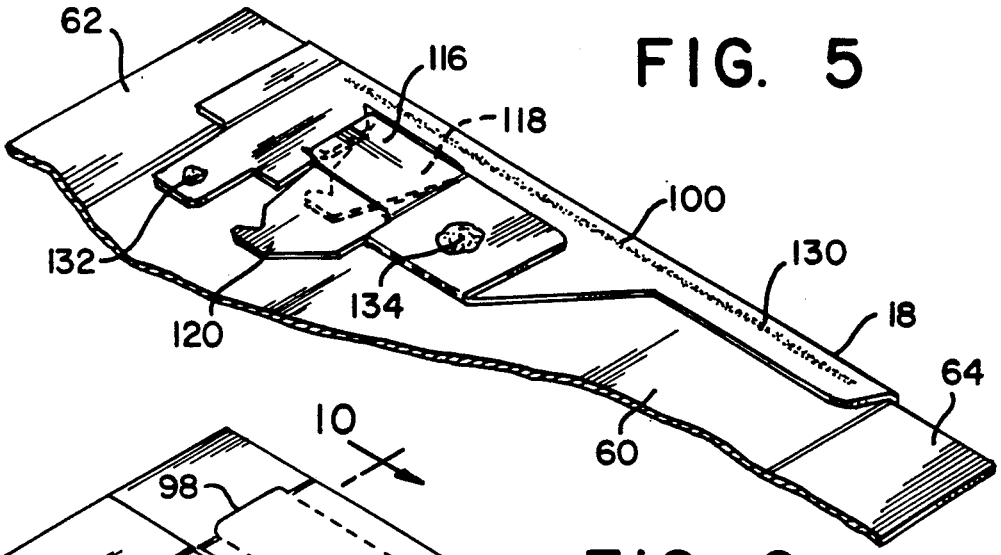
FIG. 5
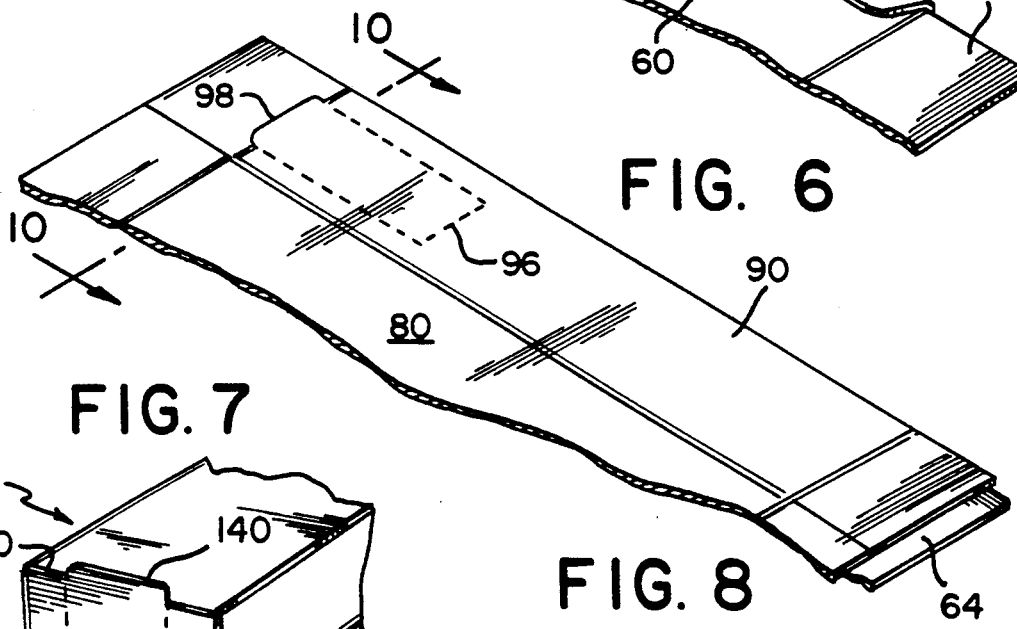
FIG. 6
FIG. 7
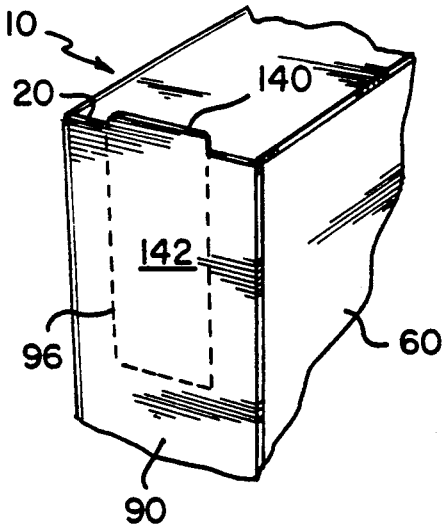
FIG. 8
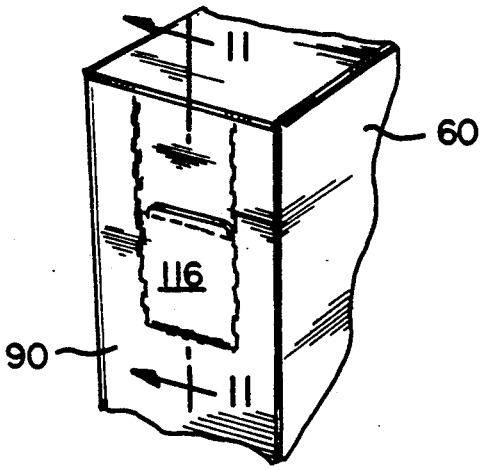

CONTAINER WITH INTEGRAL POURING SPOUT AND METHOD OF MANUFACTURE

FIELD OF THE INVENTION

The present invention relates generally to packaging and, more particularly, concerns containers with a integral pouring spout of a type useful for packaging granular food products and a method for their manufacture.

BACKGROUND OF THE INVENTION

Containers with built-in pouring spouts are widely used for granular food products. The containers are typically made of cardboard, and the sprout may be made of a separate material, such as metal, or it may be formed integrally with the rest of the container. The containers with metal spouts are formed so that the spout may be pivoted out of the container for use and pushed back into the container for storage. However, they have proven to be unreliable, because the metal spout tends to tear the container, and eventually, fall out as the result of repeated use.

Accordingly, attempts have been made to form containers with integral pivoting pouring spouts formed from the same material as the container itself, so that the spout will not separate from the container after repeated use. However, until now, it has not proved possible to manufacture a commercially acceptable container, because the known containers suffer from various shortcomings. The containers are typically formed from a die-cut cardboard sheet by various folding and gluing steps. Known containers have, however, involved such complex steps for assembly that the manufacturing equipment has been complex and expensive, and the steps for assembling the containers have been so complex as to result in too high an incidence of defective containers. A typical problem encountered is that the spout will not open properly or will jam when operated by a user.

In addition, it is important that the package be impervious to the incursion of foreign substances into the enclosed product. This has been done by providing a layer of cardboard over the integral spout and forming a perforated region in that layer about the spout. Unfortunately, the user often has difficulty opening the perforated region. In some instances, the rear of the perforated region has been bonded to the outside surface of the spout in the mistaken belief that this would simplify operation. However, the perforated region rarely remains attached to the spout, and when ultimately detached, damages the spout or makes its operation more cumbersome.

Broadly, it is an object of the present invention to provide a container and an integral pouring spout which avoids the shortcomings of known devices of this type. It is specifically contemplated that the container provide a mechanism for assuring ready and proper opening and setting up of the spout in an open position, as well as convenient closure thereof.

It is a further object of the present invention to provide such a container with a sealed layer over the spout to protect against the incursion of foreign substances into the container, this layer being convenient to open in order to expose the spout, and once open, not interfering with the operation of the spout.

It is yet another object of the present invention to provide a container with an integral spout which can be conveniently and reliably manufactured at relatively low cost.

It is also an object of the present invention to provide a container with an integral spout which is convenient and reliable in use, yet relatively inexpensive in construction.

In accordance with the present invention, a container with an integral pouring spout a method for manufacturing the same are provided, the container being manufactured from a planar blank by means of a manufacturing process which involves only a small number of very simple steps. The container has a pouring spout which is formed integrally with one of the walls of the container, and during the assembly of the container, portions of the spout are aligned with grooves in the opening for the spout, so that the components of the spout are guided, whereby the spout is opened and set up in a controlled manner. The spout is covered by an overlying layer of material and the region above the spout is perforated. The upper extreme of the perforated region extends above the top of the container to permit easy grasping and removal of the perforated region.

BRIEF DESCRIPTION OF THE DRAWINGS

The foregoing brief description, as well as further objects, features, and advantages of the present invention will be understood more completely from the following detail description of a presently preferred, but nonetheless illustrative, embodiment of the present invention, with reference being had to the accompanying drawings in which:

FIGS. 2–6 are fragmentary perspective views illustrating the sequence of steps performed on the blank of FIG. 1 to form a collapsed container including an integral spout;

FIG. 7 is a fragmentary perspective view showing the assembled container with a protective layer over the spout, the protective layer having a perforated region concealing the spout;

FIG. 8 is a perspective view similar to FIG. 7 showing the container after the removal of the perforated region to expose the spout;

DETAILED DESCRIPTION OF THE PREFERRED EMBODIMENT

Figure 1:
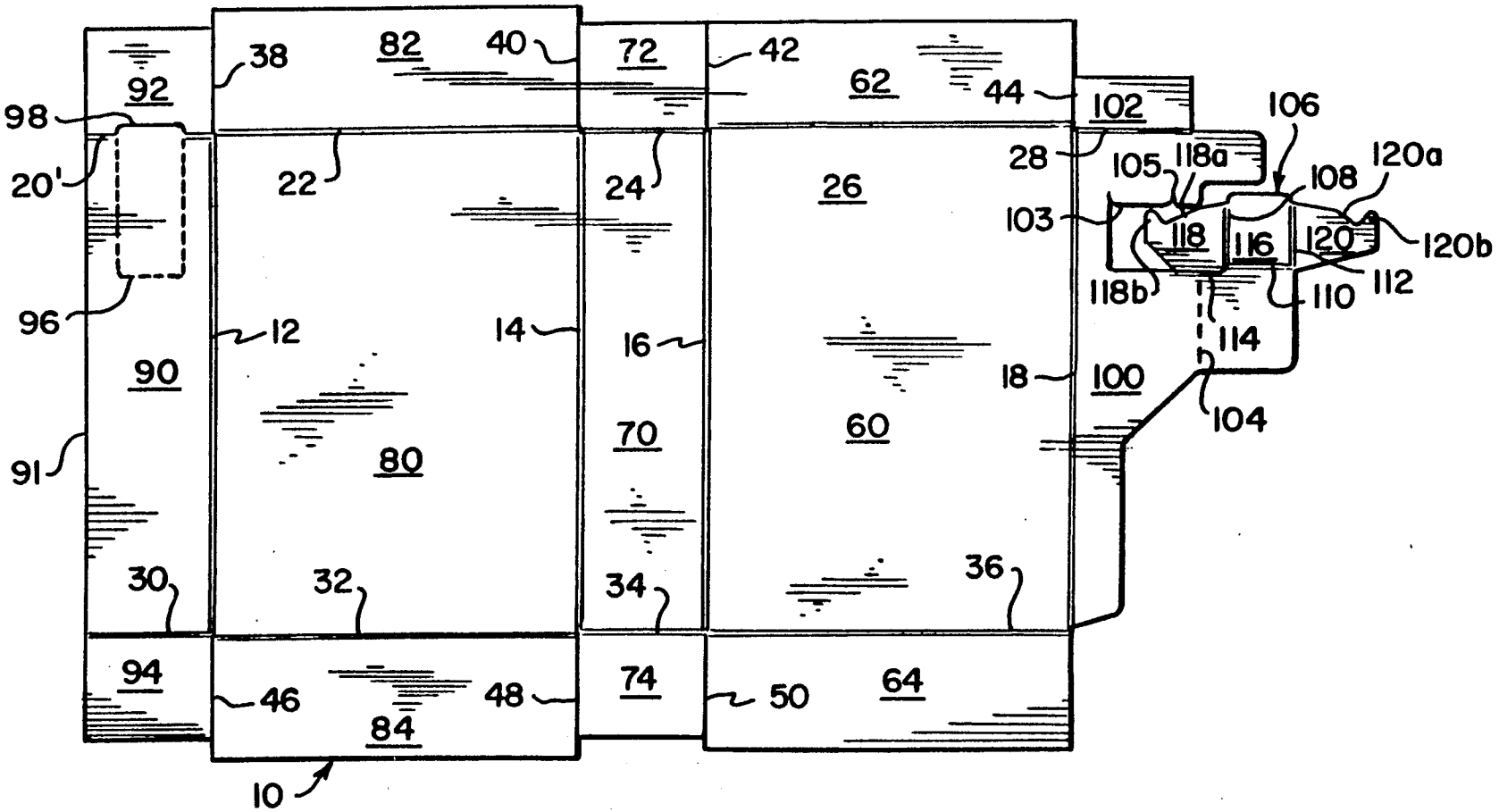
FIG. 1 is a plan view of a planar blank useful as a starting element in manufacturing a preferred embodiment of a container with an integral dispensing spout in accordance with the present invention.

Turning now to the details of the drawings, FIG. 1 is a plan view of a planar blank 10 useful in manufacturing a preferred embodiment of a container with an integral dispensing spout in accordance with the present invention.

The blank 10 is preferably made from a sheet of cardboard material by conventional techniques, as by die cutting. Blank 10 is formed with four vertical fold lines 12, 14, 16 and 18; five upper horizontal fold lines 20, 22, 24, 26 and 28; and four lower horizontal fold lines 30, 32, 34, and 36. In addition, there are provided upper cuts 38, 40, 42, and 44, and lower cuts 46, 48 and 50. The aforementioned fold lines and cuts combine to define: a rear wall 60 with upper and lower flaps 62 and 64; a center wall 70 with upper and lower flaps 72 and 74; a front wall 80 with upper and lower flaps 82 and 84; a first end wall 90 with upper and lower flaps 92 and 94; and a second end wall 100 with an upper flap 102.

End wall 90 includes a generally U-shaped perforation 96, which is topped by a cut 98, in a inverted U-shape, which extends just above fold line 20. In addition, end wall 100 is formed with a perforation 104, which is at the same distance from fold line 18 as edge 91 of wall 90 is from fold line 12. End wall 100 is also formed with an intricate cut out that produces an open area and two inverted V-shaped grooves 103, 105 and an upwardly protruding head 106.

Head 106 is formed with fold lines 108, 110 and 112 and the cut 114. Fold line 110 is at the same level as the bottom portion of perforation 96, and fold lines 108 and 112 are spaced apart the same distance as the upright portions of perforation 96. In addition, the distance between line 108 and perforation 104 is the same as the distance between the right-hand upright portion of perforation 96 and fold line 112. The fold lines and cut 114 of head 106 define a central wall portion 116, a leftwardly protruding ear 118 and a rightwardly protruding ear 120. Ear 120 includes a portion 120*a* which tapers downwardly from central wall 116 and terminates in an upwardly protruding hook portion 120*b*. Ear 118 similarly includes a tapering portion 118*a* and an upwardly protruding hook portion 118*b*.

Figure 2:
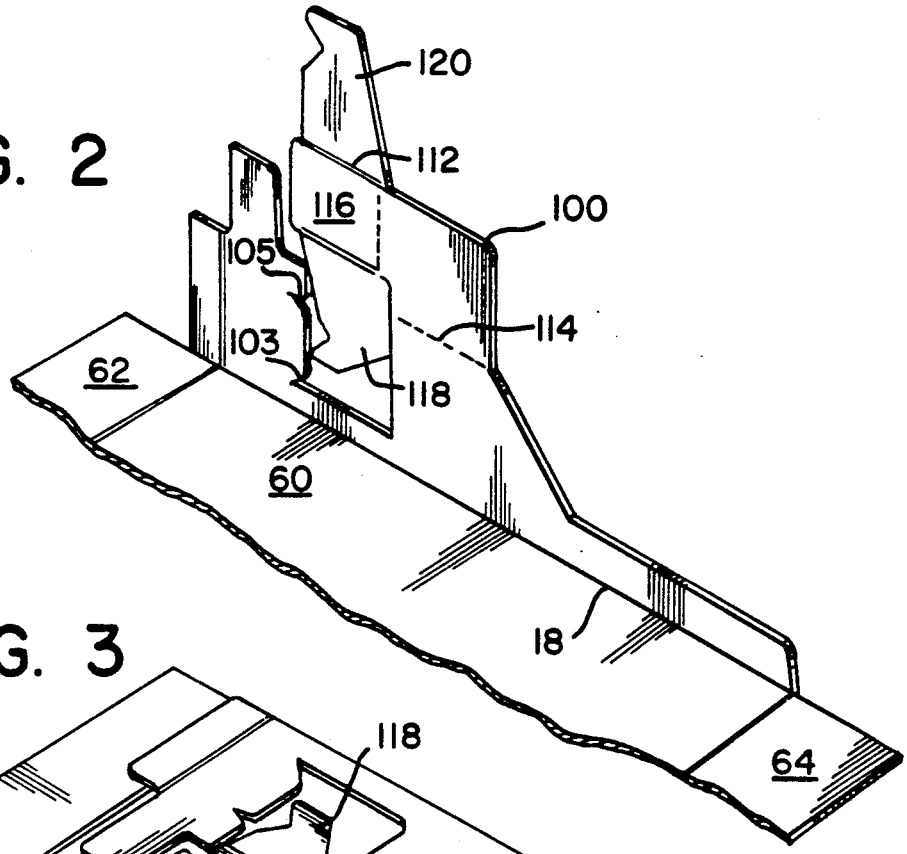
Figure 3:
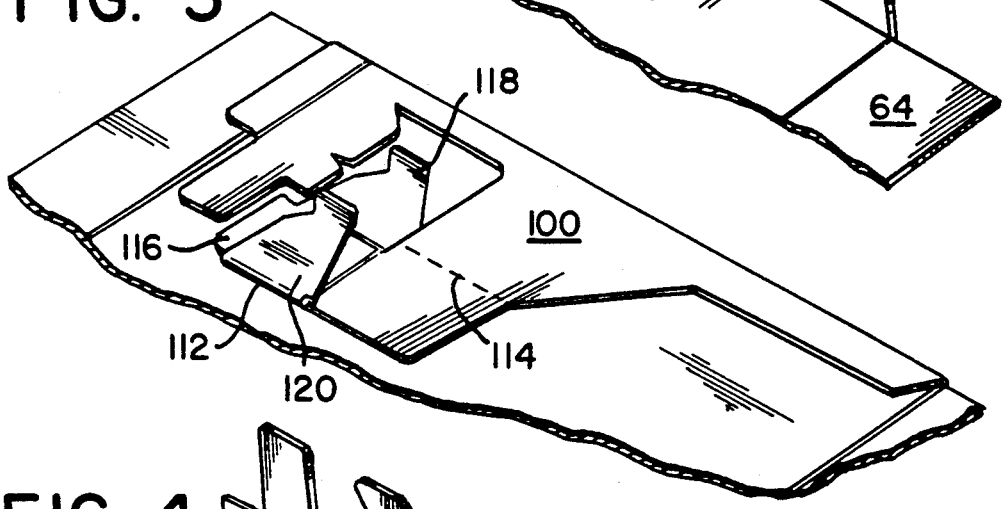

FIGS. 2–6 illustrate how blank 10 is assembled to form a container, in the preferred embodiment a cardboard box with an integral pouring spout. Initially, end wall 100 is folded along fold line 18 onto front wall 60 (FIGS. 2 and 3). Ear 120 is then folded along the fold line 112 over central wall 116 (FIG. 3). The portion of wall 100 containing head 106 is then folded along perforation 104 onto the remainder of wall 100 and ear 120 is permitted to pass through the open area adjacent groove 103.

Wall 100 is then once again folded down over wall 60 to trap ear 120 therebetween (FIG. 5). Glue is then deposited at a number of locations on wall 100, for example, an elongated strip of glue 130 adjacent to fold 18, and dabs 132 and 134. Blank 110 is then folded along fold line 114 so as to place wall 90 over wall 100 (FIG. 7), and walls 90 and 100 are pressed together to permit the glue to adhere and join them together. With walls 90 and 100 glued together, blank 10 forms an assembled unit which is basically a collapsed container with an integral spout. A plurality of such units may then be stacked and sent to customers in bulk.

Figure 10:
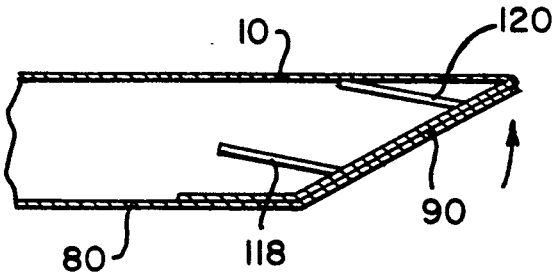
FIG. 10 is a sectional view taken along Line 10—10 and looking in the direction of the arrows in FIG. 6 showing the collapsed container as it is being brought to an open position after the walls and spout are assembled.

At the customer's plant, the individual assembled blanks may be opened up (see FIG. 10), and the flaps in 64, 74, 84 and 94 may be glued together in a conventional manner to form a closed bottom for the box. These boxes may then be filled with a particulate, granular, or powdered substance, whereupon the flaps 62, 72, 92 and 102 may be glued together in a conventional manner to form a sealed container 10, As can be seen FIG. 7, since the cut out 98 was formed so as to protrude above fold line 20, the sealed container has a protruding tab portion 140 extending above the top of the container. This tab portion 140 may be grabbed by a user in order to permit a section 142 of material circumscribed by perforation 96 to be torn away conveniently from the wall 90, which exposes the central wall 116.

Figure 4:
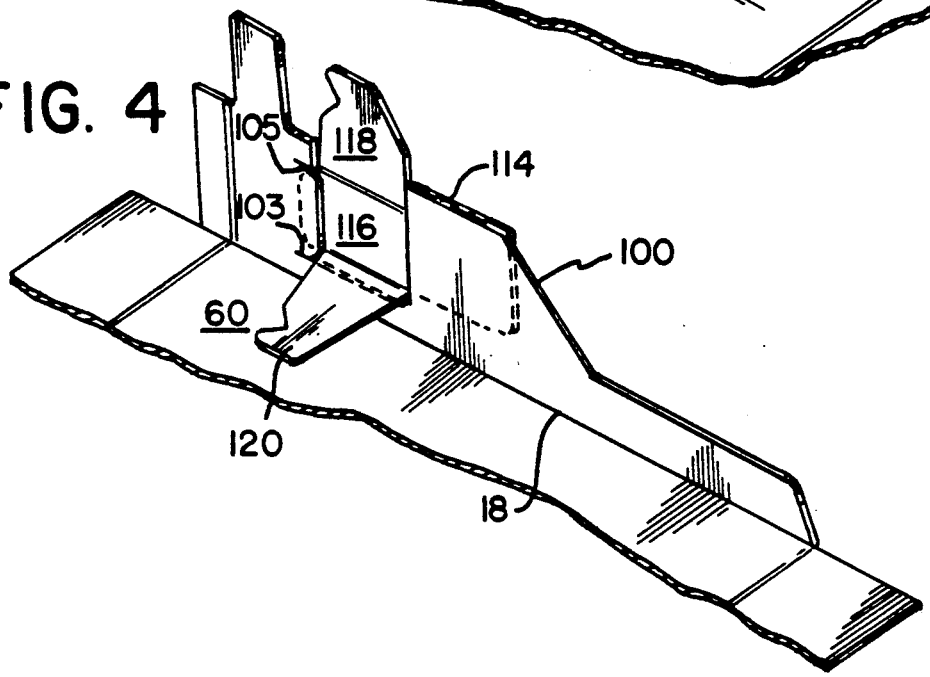
Figure 9:
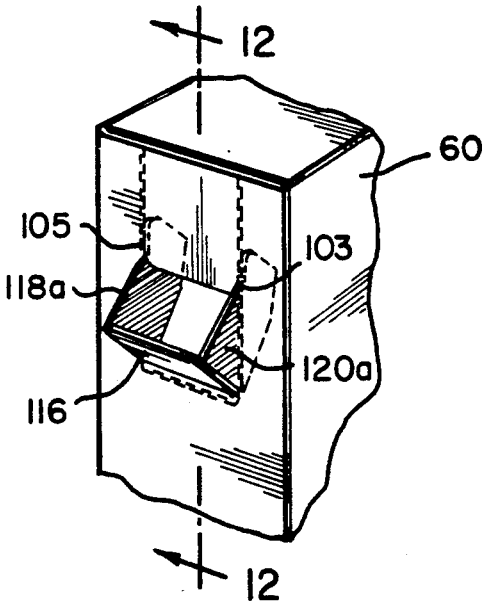
FIG. 9 is perspective view similar to FIG. 8 showing the spout when it is pivoted to an open position.
Figure 11:
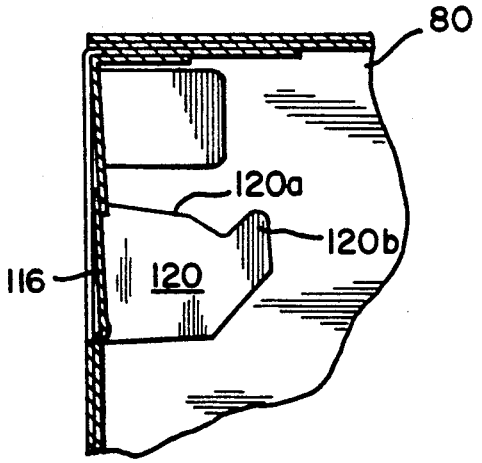
FIG. 11 is a sectional view taken along Line 11—11 in FIG. 8 and looking in the direction of the arrows.
Figure 12:
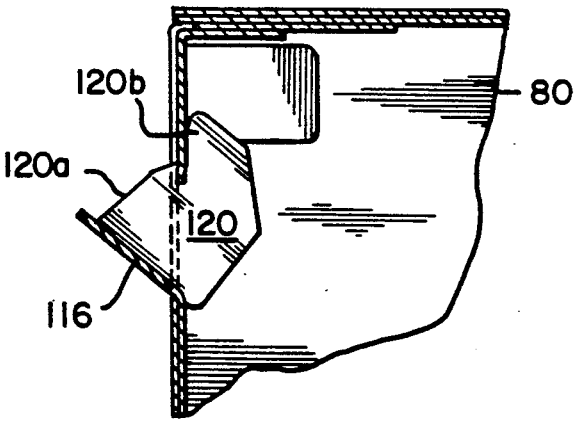
FIG. 12 is a sectional view taken along Line 12—12 in FIG. 9 and looking in the direction of the arrows.

As can be seen in FIG. 4, during assembly of the container, ear 120 is aligned with and positioned within groove 103. Also, when the glued blank is brought to its open position by separating walls 60 and 80 (see FIG. 10), flap 118 is brought into alignment within groove 105. As a result, if a user pulls the top portion of center wall 116 away from 90, tapered portions 118*a* and 120*a* are guided set up within grooves 105 and 103, respectively, as wall 116 tilts open to form a pouring sprout (see FIG. 9). Eventually, the hook portions 118*b* and 120*b* arrive behind the grooves 105 and 103, engaging the wall containing the grooves, and preventing further forward tilting of wall 116 (see FIG. 12). Naturally, the spout so formed may be closed again by pushing wall 116 back towards wall 90 (see FIG. 11).

Although a preferred embodiment of the invention has been disclosed for illustrative purposes, those skilled in the art will appreciate that many additions, modifications, and substitutions are possible without departing from the scope and spirit of the invention as disclosed in the accompanying claims.

What is claimed is:

1. A planar blank for a container with an integral pouring spout, said planar blank being made of a creasable sheet material and having a predetermined vertical and horizontal direction and left and right margins, said blank comprising:

a generally vertical first fold line disposed rightwardly of said left margin, an area leftward of said first fold line defining a first end wall, said first end wall having a top portion;

means defining a generally U-shaped perforated area near the top portion of said first end wall, said perforated area being spaced at a first predetermined distance from said left margin said perforated area having lower, left and right perforated margins, a width of said perforated area being a distance between said right and left perforated margins;

a generally vertical second fold line disposed leftwardly of said right margin, an area rightward of said second fold line, including a second end wall;

means defining a cut out in said second end wall, said cut out having a left peripheral margin disposed at said first predetermined distance from said second fold line, a lower peripheral margin aligned with the lower perforated margin of said perforated area and an upper peripheral margin at a second predetermined distance above said lower peripheral margin;

a generally vertical third fold line disposed at a third predetermined distance from said left peripheral margin;

a generally vertical fourth fold line disposed rightwardly of said third fold line at a distance therefrom which is not greater than said third predetermined distance;

a generally horizontal fifth fold line aligned with said lower peripheral margin;

a generally vertical sixth fold line spaced from said fourth fold line by a distance no greater than said width of said perforated area;

means defining a first ear element protruding rightwardly from said fourth fold line, said first ear element including an upwardly protruding hook portion at a rightmost extreme of said first ear element; and means defining a second ear element protruding leftwardly from said sixth fold line, said second ear portion including an upwardly protruding hook portion at a leftmost extreme of said second ear element.

2. The blank of claim 1 further comprising means defining a first groove in said upper peripheral margin, said first groove having an inverted V-shaped and being aligned with said left peripheral margin; and means defining a second V-shaped groove in said upper peripheral margin, said second peripheral groove being spaced from said left peripheral margin by a distance substantially equal to the distance between said fourth and sixth reference lines.

3. A container with an integral pouring spout, said container having a top and a wall containing said spout, said container comprising:

a middle layer of said wall having said spout formed integrally therewith so as to pivot outwardly, said spout including an ear portion on either of two sides of said spout extending into said container;

a rear layer of said wall underlying said middle layer and having an opening therein which is dimensioned to receive the ear portions of said spout and to be covered by said spout;

a front layer of said wall overlying said spout and being formed with a perforated region having a perforation circumscribing said spout from below and on either of said side of said spout; and an upwardly projecting integral extension of said perforated region extending above the top of said container, whereby said perforated region can be readily removed by grasping said upwardly projecting region.

4. The container of claim 3 wherein said middle layer opening further includes a pair of spaced grooves having a generally inverted V-shape and being each aligned with one of said rearwardly projecting ears of said spout, in order to guide said spout while said spout is being pivoted.

5. A method of partially forming a container with an integral pouring spout from a planar blank, said planar blank having: a predefined vertical and horizontal direction and left and right margins; a generally vertical first fold line disposed rightwardly of said left margin; an area leftward of said first fold line defining a first end wall, said first end wall having a top portion; means defining a generally U-shaped perforated area near the top portion of said first end wall, said perforated area being spaced at a first predetermined distance from said left margin said perforated area having lower, left and right perforated margins, a width of said perforated area being a distance between said right and left perforated margins; a generally vertical second fold line disposed leftwardly of said right margin; an area rightward of said second fold line, including a second end wall; means defining a cut out in said second end wall, said cut out having a left peripheral margin disposed at said first predetermined distance from said second fold line; a lower peripheral margin aligned with the lower perforated margin of said perforated area and an upper peripheral margin at a second predetermined distance above said lower peripheral margin; a generally vertical third fold line disposed at a third predetermined distance from said left peripheral margin; a generally vertical fourth fold line disposed rightwardly of said third fold line at a distance therefrom which is not greater than said third predetermined distance; a generally horizontal fifth fold line aligned with said lower peripheral margin; a generally vertical sixth fold line spaced from said fourth fold line by a distance no greater than said width of said perforated area; means defining a first ear element protruding rightwardly from said fourth fold line, said first ear element including an upwardly protruding hook portion at a rightmost extreme of said first ear element; means defining a second ear element protruding leftwardly from said sixth fold line, said second ear portion including an upwardly protruding hook portion at a leftmost extreme of said second ear element, said method comprising:

folding said first ear portion under said blank about said fourth fold line;

folding all of said blank to the right of said third fold line under said blank about said third fold line;

passing said first ear portion through said cut out adjacent said left peripheral margin;

folding all of said blank to the right of said second fold line over said blank about said second reference line; and with the blank so folded, securing an upper surface of a said first end wall in contact with an under surface of said second end wall so that said left margin is aligned with said second fold line.

* * * * *